United States Patent [19]

Schwartz

[11] Patent Number: 4,899,557

[45] Date of Patent: Feb. 13, 1990

[54] STABLE FINGERNAIL RING

[76] Inventor: Marcus Schwartz, 5642 Etiwanda Ave., #10, Tarzana, Calif. 91356

[21] Appl. No.: 248,614

[22] Filed: Sep. 26, 1988

[51] Int. Cl.[4] ..... A44C 9/02

[52] U.S. Cl. ..... 63/15

[58] Field of Search ..... 2/21; 84/322; 224/217; 63/15, 3, 2, 15.45, 15.5; D11/34, 36

[56] References Cited

U.S. PATENT DOCUMENTS

| | | | |
|---|---|---|---|
| D. 243,359 | 2/1977 | Nevrous | 63/3 X |
| D. 273,283 | 4/1984 | Bulgari | D11/34 |
| 203,978 | 5/1878 | Woods . | |
| 336,974 | 3/1886 | Withrow . | |
| 888,976 | 5/1908 | Duperrault . | |
| 1,018,875 | 2/1912 | Cardon . | |
| 1,439,811 | 12/1922 | Givens . | |
| 1,516,385 | 11/1924 | Keck . | |
| 2,323,854 | 7/1943 | Silverman . | |
| 2,441,947 | 5/1948 | Welch . | |
| 2,458,709 | 1/1949 | Kayer . | |
| 2,487,101 | 11/1949 | Colby . | |
| 2,546,619 | 3/1951 | Turner . | |
| 2,591,092 | 4/1952 | Okonski . | |
| 2,740,121 | 4/1956 | Seidel . | |
| 3,638,525 | 2/1972 | Sciurba et al. | 84/322 X |
| 3,728,736 | 4/1973 | Pugh . | |
| 3,739,681 | 6/1973 | Dunlop | 84/322 |
| 4,497,237 | 2/1985 | Beall | 84/322 |

FOREIGN PATENT DOCUMENTS

| | | | |
|---|---|---|---|
| 1310161 | 10/1962 | France . | |
| 1347157 | 11/1963 | France | 63/2 |

*Primary Examiner*—James R. Brittain

*Attorney, Agent, or Firm*—Thomas I. Rozsa

[57] ABSTRACT

A stable fingernail ring which is a ring designed to be worn immediately behind the first knuckle of any finger, and comprising a circular supporting section designed to be worn around the finger between the first and second knuckle and preferably immediately behind the first knuckle, a decorative section on the upper portion of the ring and supported by the circular supporting section and which extends over the fingernail of the finger on which the ring is worn, and a stabilizing section on the bottom of the ring which is designed to assure that the ring will be stabilized on the wearer's hand.

2 Claims, 1 Drawing Sheet

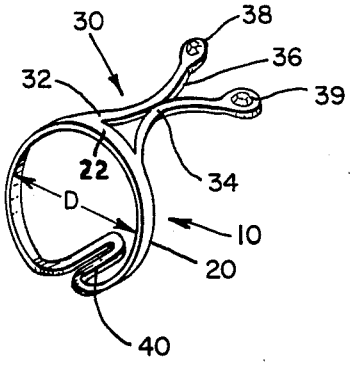
Fig. 1.
Fig. 4.
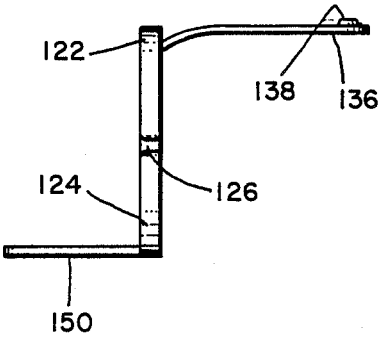
Fig. 5.
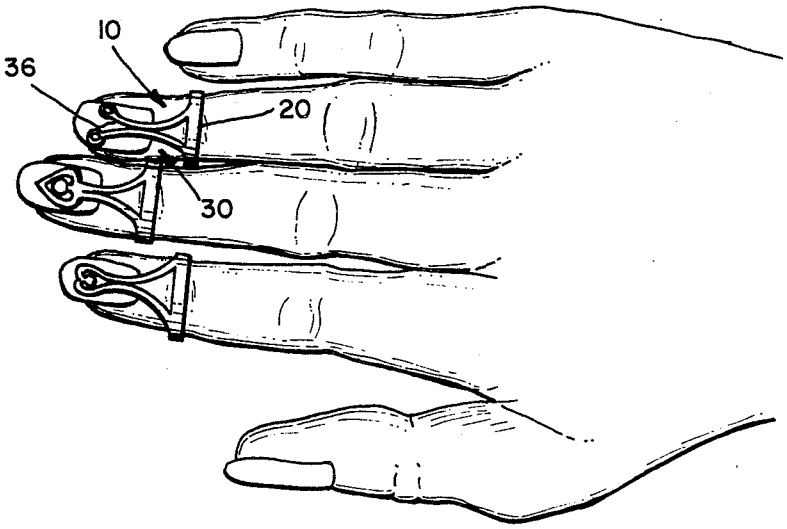
Fig. 2.
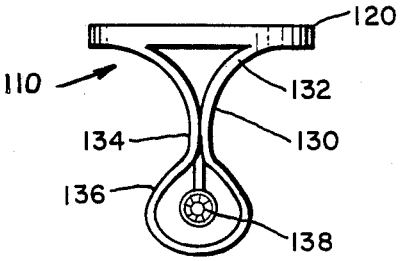
Fig. 3.
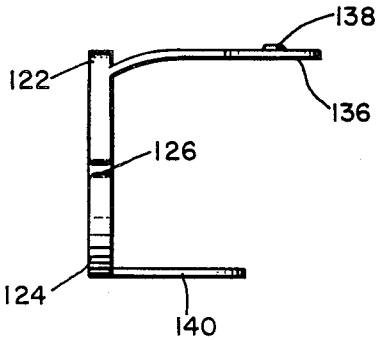

STABLE FINGERNAIL RING

BACKGROUND OF THE INVENTION

1. Field of the Invention

The field of the present invention relates to decorative jewelry items which are worn to adorn certain parts of the body. In particular, the present invention relates to rings which are worn on the finger and used to adorn the fingernail.

2. Description of the Prior Art

In general, many types of rings are known in the prior art. The conventional finger ring consists of a circular piece of material designed to fit around a particular finger of the hand and a decorative item such as a stone resting on top of the circular piece of material and within a setting. Most rings are designed to be worn at the base of the third section of the finger where it joins the upper body and palm of the hand.

Several types of finger rings which are designed to be worn on other parts of the finger are disclosed in the following patents:

1. French Pat. No. 1,310,161 issued in 1962 to Leostic et al.

2. U.S. Pat. No. 1,018,875 issued to Cardon in 1912 for "Finger Ring Construction".

French Pat. No. 1,310,161 discloses of finger ring in which the circular portion of the ring is designed to be worn immediately behind the first knuckle and which contains a decorative item such as a pear shaped piece, designed to be worn over the fingernail. The method by which the ring is stabilized is to have a portion of the decorative item hooked over the wearer's fingernail, as shown in FIG. 3 of that patent. While this patent discloses a decorative ring, its methods of stabilization is cumbersome, unstable, and probably painful. By requiring the decorative portion to be hooked onto the end of the fingernail, it is easy for the fingernail tip to break off. The item also puts pressure on the fingernail. Due to this method of hooking, it is also easy for the decorative tip to become loosened from the fingernail, thereby permitting the ring to fall off. In addition, since the hooking method is in front of the fingernail and the circular portion is wider than the front section of the finger, there is nothing to stabilize the ring on the finger and if the wearer points the finger downwardly, it is easy for the ring to fall off.

U.S. Pat. No. 1,0189,875 issued to Cardon discloses a finger ring which covers the second and third section of a finger, but not the nail.

The following patents disclose devices designed to protect the front of the finger and the nail while the finger is being used for a particular purpose:

1. U.S. Pat. No. 888,976 issued to Duperault in 1908 for "Thumb Or Finger Attachment".

2. U.S. Pat. No. 203,978 issued in 1878 to Woods for "Tobacco Germer".

3. U.S. Pat. No. 336,974 issued to Withrow in 1886 for "Corn Husker".

4. U.S. Pat. No. 3,728,736 issued to Pugh in 1973 for "Thumb Or Finger Guard".

5. U.S. Pat. No. 2,740,121 issued to Seidel in 1956 for "Finger Cot".

6. U.S. Pat. No. 2,591,092 issued to Okonski in 1952 for "Fingernail Guard".

7. U.S. Pat. No. 2,546,619 issued to Turner in 1951 for "Fingernail Guard".

8. U.S. Pat. No. 2,487,101 issued to Colby et al in 1949 for "Fingernail Protector".

9. U.S. Pat. No. 2,458,709 issued to Kayer in 1949 for "Fingernail Guard".

10. U.S. Pat. No. 2,441,947 issued to Welch in 1948 for "Bobby Pin Opener".

11. U.S. Pat. No. 2,323,854 issued to Silverman in 1943 for "Finger Nail Guard".

12. U.S. Pat. No. 1,516,385 issued to Keck in 1924 for "Thumb Shield".

13. U.S. Pat. No. 1,439,811 issued to Givens in 1922 for "Finger Ring For Handling Paper Sheets".

Each of the above patents illustrate an attachment designed to protect the front of the forefinger while the finger is being used to perform certain tasks such as to sort mail. None of the devices functions as a decorative item and are strictly protective items.

There is no prior art decorative finger ring which is designed to be worn immediately past the first knuckle of the finger and is placed on the finger in a stabilized manner such that the fingernail is covered with a decorative item portion of the ring. While the French patent issued to Leostic et al discloses such a ring in general, the method of stabilization is such that the ring can easily fall off or chip the fingernail. Therefore, a significant need exists for a stable decorative ring designed to cover the fingernail, which at the same time is stabilized so as to not easily fall off the finger and further does not hook onto the fingernail to thereby possibly break the fingernail or cause pain.

SUMMARY OF THE PRESENT INVENTION

The present invention relates to a stable fingernail ring which is a ring designed to be worn immediately behind the first knuckle of any finger, and comprising a circular supporting section designed to be worn around the finger between the first and second knuckle and preferably immediately behind the first knuckle, a decorative section on the upper portion of the ring and supported by the circular supporting section and which extends over the fingernail of the finger on which the ring is worn, and a stabilizing section on the bottom of the ring which is designed to assure that the ring will be stabilized on the wearer's hand.

It has been discovered, according to the present invention, that if a flat forwardly extending element is placed on the bottom of a ring and attached to its circular supporting section, then the ring can be worn between the first and second knuckles and will not fall off because the flat piece on the bottom of the ring will serve as a securing means to prevent the ring form falling off.

It has further been discovered, according to the present invention, that the combination of a top decorative portion which extends forwardly of the circular supporting portion of a ring when combined with a bottom stabilizing portion which also extends either forwardly or rearwardly of the circular supporting portion of a ring provides a decorative stabilzed jewelry item by which the ring can be worn between the first and second knuckles and the decorative item extends over and covers the fingernail of the finger on which the ring is worn while at the same time providing a stable ring which will not fall off and a ring which can cover the fingernail without potentially damaging the fingernail.

It has additionally been discovered, according to the present invention, that if the circular supporting section contains a gap in its circumference, then the ring can be tigthened about the finger to provide a secure fit between the first and second knuckles and the decorative item extends over and covers the fingernail of the finger on which the ring is worn while at the same time providing a stable ring which will not fall off and a ring which can cover the fingernail without potentially damaging the fingernail.

It is therefore an object of the present invention to provide a decorative jewelry fingernail ring which can be worn between the first and second knuckle of any finger and which has its decorative element extending over the fingernail of the finger on which the ring is worn.

It is another object of the present invention to provide a stable fingernail ring which can be securely worn between the first and second knuckles of a finger without falling off.

It is a further object of the present invention to provide a fingernail ring which can cover the fingernail without being hooked onto the fingernail.

It is an additional object of the present invention to provide a fingernail ring which can cover the fingernail without damaging the fingernail it is covering.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a perspective view of one embodiment of the present invention fingernail ring with one embodiment of a decorative top portion.

FIG. 2 is a top plan view of a second embodiment of the present invention fingernail ring with a second embodiment of a decorative top portion.

FIG. 3 is a side elevational view of the present invention fingernail ring illustrated in FIG. 2, with a stabilizing means extending in the forward direction toward the tip of a finger on which the ring would be worn.

FIG. 4 is a side elevational view of the present invention fingernail ring illustrated in FIG. 2, with a stabilizing means extending in the rearward direction toward the base of a finger on which the ring would be worn.

FIG. 5 is a top plan view of the present invention fingernail ring illustrating three fingernail rings with one ring worn on each of the second, third and fourth fingers of the right hand and with a different decorative top on each ring.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many specific embodiments which can represent applications of the principles of the invention. Various changes and modifications obvious to one skilled in the art to which the invention pertains are deemed to be within the spirit, scope and contemplation of the invention as further defined in the appended claims.

Referring to FIG. 1, there is shown at 10 the present invention stable fingernail ring. The fingernail ring 10 consists of three primary sections. A centrally disposed supporting section 20 is shown as a completely encircled ring in FIG. 1 and is intended to support the fingernail ring 10 on the wearer's finger. The diameter "D" of the supporting section 20 is sized so as to fit between the first and second knuckles of the intended finger and preferably sized to fit just behind the first knuckle of the intended finger. While the supporting section 20 is shown completely enclosed, it will be appreciated that the supporting section can be open at one point along its circumference (as shown in FIG. 3) so that the diameter of the fingernail ring can be increased or decreased to accommodate the individual wearer's finger.

Supported on the top area 22 of supporting section 20 is the decorative section 30 of the fingernail ring 10. The decorative section 30 comprises a base portion 32 by which the decorative section 30 is attached to the supporting section 20, an elongated portion 34 and a fingernail covering portion 36. The elongated portion 34 extends from the base portion 32 to the fingernail covering portion 36 and is designed to fit the specific finger so that the fingernail covering portion will lie above the fingernail. The fingernail covering portion is the decorative portion of the fingernail ring 10 and has at least one decorative element 38. The specific fingernail covering portion shown in FIG. 1 has two such decorative elements, 38 and 39. It will be appreciated that the specific decorative design can have any number of such decorative elements.

Supported on the bottom area 24 of the supporting section 20 is the stabilizing section 40. The stabilizing section is a longitudinal member which extends from the bottom area 24 of supporting section 20 in a forward direction, generally parallel to the elongated portion of the decorative section 30. It is within the spirit and scope of the present invention for the stabilizing section 40 to extend for any length from the the supporting section 20, including a length up to the length of the entire decorative section 30. However, in the preferred embodiment, the stabilizing section will extend for a distance from the supporting section 20 up to the bend of the first knuckle. In this way, the wearer can also bend the first section of her finger.

Alternatively, the stabilizing section can extend in a rearward direction toward the base of the finger, as illustrated in FIG. 4.

An alternative embodiment of the fingernail ring 110 is shown in FIGS. 2, 3 and 4. The fingernail ring 110 has the same three sections; a supporting section 102, a decorative section 130 and a stabilizing section either 140 or 150. The only difference is that the supporting section 120 has a gap 126 in its circumference so that the diameter of supporting section can be increased or decreased in order to adjust the specific fit to the individual wearer's finger. In addition, by tightening the ring, the ring can be further stabilized on the wearer's finger. The decorative section has a decorative portion 136 with only one decorative element 138.

As with the first embodiment, supported on the top area 122 of supporting section 20 is the decorative section 130 of the fingernail ring 110. The decorative section 130 comprises a base portion 132 by which the decorative section 130 is attached to the supporting section 120, an elongated portion 134 and a fingernail covering portion 136. The elongated portion 132 extends from the base portion 122 to the fingernail covering portion 136 and is designed to fit the specific finger so that the fingernail covering portion will lie above the fingernail.

With the gap 126 facilitating the tightening of ring, it is possible to eliminate the stabilizing section and just have the supporting section 120 tightened about the wearer's finger. However, it is also possible to include a supporting section. In this case, supported adjacent the bottom area 124 of the supporting section 120 is the stabilizing section either 140 or 150. In the embodiment shown in FIG. 3, the stabilizing section is a longitudinal member which extends from the bottom area 124 of supporting section 120 in a forward direction toward the tip of the finger on which the ring would be worn, generally parallel to the elongated portion of the decorative section 130. It is within the spirit and scope of the present invention for the stabilizing section 140 to extend for any length from the the supporting section 120, including a length up to the length of the entire decorative section 130. However, in the preferred embodiment, the stabilizing section will extend for a distance from the supporting section 120 up to the bend of the first knuckle. In this way, the wearer can also bend the first section of her finger. In the embodiment shown in FIG. 4, the stabilizing section is a longitudinal member which extend from the bottom area 124 of supporting section 120 in a rearward direction toward the base of the finger on which the ring would be worn. It is within the spirit and scope of the present invention for the stabilizing section 150 to extend for any length from the the supporting section 120. However, in the preferred embodiment, the stabilizing section will extend for a distance from the supporting section 120 up to the bend of the second knuckle. In this way, the wearer can also bend the second section of her finger.

The way the fingernail ring 10 is worn on the fingers of a hand is illustrated in FIG. 5. While the illustration shows a ring worn on the second, third and fourth fingers of the right hand, it will be appreciated that the present invention fingernail ring 10 can be worn on any or all of the fingers of either or both hands. As shown, the supporting section 20 is just behind the first knuckle and the decorative portion 36 of the decorative section 30 rests over the fingernail. In this way, the fingernail is covered with a decorative object but the fingernail is not attached to the decorative object. Therefore, the fingernail will not break. By including the stabilizing section 40 beneath the finger, the fingernail ring 10 can be tight around the finger. The stabilizing section 40 can be bent upwardly toward the decorative section 30 to tighten the grip of the fingernail ring 10 around the finger to assure that it will not fall off even if the wearer points her finger carrying the ring downwardly or shakes her finger in the air. In addition, the stabilizing section 40 provides a bottom base to assure that the ring will not rotate on the wearer's finger.

The present invention fingernail ring 10 can be made of any material from which rings are conventionally made, including simple metals such as tin or aluminum or precious metals such as gold, silver and platinum. Similarly, the decorative portion and decorative element can be inexpensive items such as rhinestones or expensive stones such as diamonds, rubies and emeralds.

Defined more broadly, the present invention is a finger ring comprising:

a. a supporting section which supports the ring between the first and second knuckle of a finger;

b. a decorative section further comprising a base portion attached to the supporting section, an elongated portion extending from the base portion, and a decorative portion extending from the elongated portion;

c. said decorative portion of the decorative section resting over the fingernail and not attached to the fingernail of the finger on which the ring is supported; and d. a stabilizing section attached to and extending perpendicular to the supporting section and positioned beneath the finger on which the supporting section is located.

The stabilizing section can be a flat element extending in the direction of the tip of the finger and is attached adjacent the bottom of the supporting section.

The stabilizing section can be a flat element extending in the direction of the base of the finger and is attached adjacent the bottom of the supporting section.

In one embodiment, the stabilizing section is attached to and extends from the supporting section in the same direction as said elongated portion and said decorative portion of said decorative section.

In another embodiment, the stabilizing section is attached to and extends from the supporting section in the direction opposite to the direction of said elongated portion and said decorative portion of said decorative section.

The base portion of said decorative section is attached adjacent the top of said supporting section so that the base portion and the elongated portion of said decorative section rest on top of the finger on which the supporting section is located.

In another embodiment, the present invention is a finger ring comprising:

a. a supporting section which supports the ring between the first and second knuckle of a finger;

b. a decorative section further comprising a base portion attached to the supporting section, an elongated portion extending from the base portion, and a decorative portion extending from the elongated portion;

c. said decorative portion of the ring resting over the fingernail and not attached to the fingernail of the finger on which the ring is supported; and d. said supporting section comprising a generally circular ring have a gap in its circumference;

e. whereby said ring can be tightened and stabilized on said finger by reducing the diameter of the supporting section to tighten the supporting section around the finger.

The stabilizing section can be attached to and extend from the supporting section in the same direction as said elongated portion and said decorative portion of said decorative section and positioned beneath the finger on which the supporting section is located.

The stabilizing section can be attached to and extend from the supporting section in the direction opposite to the direction of said elongated portion and said decorative portion of said decorative section and positioned beneath the finger on which the supporting section is located.

The stabilizing section can be a flat element extending in the direction of the tip of the finger and is attached adjacent the bottom of the supporting section.

The stabilizing section can be a flat element extending in the direction of the base of the finger and is attached adjacent the bottom of the supporting section.

The base portion of said decorative section is attached adjacent the top of said supporting section so that the base portion and the elongated portion of said decorative section rest on top of the finger on which the supporting section is located.

The present invention can also be defined as a finger ring comprising:

a. a supporting section which supports a decorative section thereon such that the supporting section can be worn between the first and second knuckle of a finger in a manner which permits at least one decorative element contained within the decorative section to rest above the fingernail without being attached to the fingernail of the finger on which the supporting section is located; and b. means for stabilizing the finger ring at its location between the first and second knuckle so the finger ring will not fall off the finger.

The supporting section can be a generally circular ring containing a gap; and the means for stabilizing the finger ring is the gap in said supporting section whereby the diameter of the supporting section can be reduced by compressing the supporting section about the finger.

The means for stabilizing the finger ring can be a flat element attached to the supporting section so that the flat element extends beneath the finger in the direction of the tip of the finger.

The means for stabilizing the finger ring can be a flat element attached to the supporting section so that the flat element extends beneath the finger in the direction of the base of the finger.

The size of the fingernail ring 10 can vary so as to accommodate standard sizes of fingers for each of the fingers of both hands. While the fingernail ring 10 is primarily intended for women, it will be appreciated that men can also wear such rings. Therefore, the sizes of the rings can be designed to accommodate the fingers of men and women. As with other rings, the present invention can be incorporated into numerous sizes to accommodate the different sizes of fingers of both men and women.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way ay to limit the broad features or principles of the invention, or the scope of patent monopoly to be granted.

What is claimed is:

1. A finger ring comprising:

a. a supporting section which supports the ring between the first and second knuckle of a finger;

b. said supporting section comprising a generally circular ring have a gap in its circumference;

c. a decorative section further comprising a base portion attached to the supporting section, an elongated portion extending from the base portion, and a decorative portion extending from the elongated portion;

d. said base portion of said decorative section is attached adjacent the top of said supporting section so that the base portion and the elongated portion of said decorative section rest on top of the finger on which the supporting section is located;

e. said decorative portion of the decorative section resting over the fingernail of the finger on which the ring is supported;

f. a stabilizing section attached to and extending perpendicular to the supporting section and positioned beneath the finger on which the supporting section is located; and g. said stabilizing section is a flat element extending in the direction of the tip of the finger and is attached adjacent the bottom of the supporting section;

h. whereby the supporting section and the stabilizing section enable the ring to be securely retained on the finger and enable the decorative portion of the decorative section to rest securely on the finger nail and said ring can be tightened and further stabilized on said finger by reducing the diameter of the supporting section to tighten the supporting section around the finger.

2. A finger ring comprising:

a. a supporting section which supports the ring between the first and second knuckle of a finger;

b. said supporting section comprising a generally circular ring have a gap in its circumference;

c. a decorative section further comprising a base portion attached to the supporting section, an elongated portion extending from the base portion, and a decorative portion extending from the elongated portion;

d. said base portion of said decorative section is attached adjacent the top of said supporting section so that the base portion and the elongated portion of said decorative section rest on top of the finger on which the supporting section is located;

e. said decorative portion of the decorative section resting over the fingernail of the finger on which the ring is supported;

f. a stabilizing section attached to and extending perpendicular to the supporting section and positioned beneath the finger on which the supporting section is located; and g. said stabilizing section is a flat element extending in the direction of the base of the finger and is attached adjacent the bottom of the supporting section;

h. whereby the supporting section and the stabilizing section enable the ring to be securely retained on the finger and enable the decorative portion of the decorative section to rest securely on the finger nail and said ring can be tightened and further stabilized on said finger by reducing the diameter of the supporting section to tighten the supporting section around the finger.

* * * * *